US007111603B1

(12) United States Patent
Davis

(10) Patent No.: US 7,111,603 B1
(45) Date of Patent: Sep. 26, 2006

(54) HELI-SHAFT

(76) Inventor: Kenneth Michael Davis, 71003 16th Ave., South Haven, MI (US) 49090

( * ) Notice: Subject to any disclaimer, the term of this patent is extended or adjusted under 35 U.S.C. 154(b) by 210 days.

(21) Appl. No.: 10/707,783

(22) Filed: Jan. 12, 2004

(51) Int. Cl.
*F01L 7/00* (2006.01)

(52) U.S. Cl. ..... 123/190.12; 123/190.8

(58) Field of Classification Search ..... 123/80 C, 123/80 R, 80 BA, 190.12, 190.4, 190.5, 190.6, 123/190.8
See application file for complete search history.

(56) References Cited

U.S. PATENT DOCUMENTS 4,944,262 A * 7/1990 Molina et al. ..... 123/190.8
5,052,349 A * 10/1991 Buelna ..... 123/80 BA
5,315,969 A * 5/1994 MacMillan ..... 123/190.6
5,410,996 A * 5/1995 Baird ..... 123/190.2
5,474,036 A * 12/1995 Hansen et al. ..... 123/80 BB
5,526,780 A * 6/1996 Wallis ..... 123/190.6
5,706,775 A * 1/1998 Schweter et al. ..... 123/190.12
5,724,926 A * 3/1998 Wilke ..... 123/80 BA

* cited by examiner

*Primary Examiner*—Henry C. Yuen
*Assistant Examiner*—Jason Benton

(57) ABSTRACT

The HELI-SHAFT intake exhaust manifold system is comprised of a shaft with two helical and parallel runners cutout around its length. Surrounding the shaft is a sleeve of the same length to enclose and separate the two runners. The intake runner has an opening at the front end of the shaft to provide an inlet for the air/fuel mixture to enter from the intake plenum. Exhaust gases exit the rear of the shaft through the exhaust opening; thus allowing the air/fuel mixture and exhaust gases to travel through the sleeved shaft following the runners in a parallel path. The shaft also provides locations for spark plugs to be inserted. The sleeve contains port openings located over each intake and exhaust runner positioned to provide alignment during rotation with individual combustion chambers aligned in a row matching both the firing order and cycle timing of the engine.

1 Claim, 5 Drawing Sheets

APPLICATION EXAMPLE

SMALL BLOCK CHEVY ODD BANK COMBUSTION CHAMBERS 1,3,5,7

FIRING ORDER 1,8,4,3,6,5,7,2

* NOTE: SHAFT ROTATES 45 DEGREES PER FIRING SEQUENCE

HELI-SHAFT

BACKGROUND OF INVENTION

The present invention relates to intake and exhaust valve assemblies, related ignition systems and intake and exhaust manifolds for internal combustion engines.

Internal combustion engines typically employ poppet type valves combined with a distributed runner intake manifold system for air/fuel intake delivery to the combustion chamber(s). Additionally exhaust gases are generally expelled through poppet type valves combined with a collective runner exhaust manifold system for exhaust handling and discharge.

The operating cycle of an internal combustion engine consisting of four phases in the four-stroke model is comprised of an intake phase, compression phase, ignition to achieve an expansion or power phase, and an exhaust phase; this requires one turn of the camshaft(s) and two turns of the crankshaft. Current engine head designs used in automotive and marine applications are generally based upon this common design principle for delivery to the combustion chambers air/fuel for intake, provide combustion chamber shutoff to achieve air/fuel mixture compression, introduce an ignition device for the expansion or power and provide an outlet for exhaust gases. While many variations based upon this common theme do exist the fundamental approach is consistent.

Current engine valve train designs typically contain most or all of the following components: camshaft(s), linear poppet valves, valve springs, valve retainers, rockers, lifters, and pushrods; while the current internal combustion engine has a very reliable valve train design, it does require a considerable amount of energy during operation to overcome the mechanical resistance inherent to its design. Moreover, additional complexities and refinements made to this design increasingly achieve less significant gains due to the aggregate effect of many components nearing their physical design limits.

The HELI-SHAFT intake and exhaust manifold system is designed to improve overall engine performance and reliability offering adaptability to both existing engine designs either as a retrofit or as a complete integrated original equipment manufacturing solution. Central to this design is a less restrictive and more efficient intake and exhaust manifold system. By significantly reducing the energy required to drive the system as compared to conventional valve head assemblies, more usable horsepower is ultimately available for use by the drive train of a vehicle. In addition, by improving the power to weight ratio of the internal combustion engine, broader more flexible design options are available.

SUMMARY OF INVENTION

The HELI-SHAFT design provides a unique method of air/fuel delivery and exhaust with much fewer individual components, presents a very low mechanical resistance profile during operation and also incorporates an advanced integrated ignition system. Additionally this design provides an ideal platform for both existing and future adaptation of performance enhancing components such as turbo charging, super charging, direct injection fuel delivery and advancing computer controlled engine management systems.

The initial design is based upon adaptation to an existing standard V8 engine configuration. Air/fuel delivery is directed to each bank of four cylinders via two belt driven overhead rotating sleeved shafts incorporating a helical type cutout or internal runner along the length of each shaft specifically designed to match the firing order of the engine. These shafts are driven by the crankshaft at a ratio of two turns of the crankshaft equaling one turn of the HELI-SHAFT. Port openings are provided in the surrounding sleeve(s) and registered or timed to align with each of the four cylinders during the intake phase. Parallel to the intake runner is an offset exhaust runner positioned to allow timed alignment with corresponding exhaust port openings in the sleeve(s) providing an opening during the exhaust phase of each cylinder.

The intake runner in each shaft is filled in the front of the engine by a common intake plenum and air/fuel mixture is drawn in through vacuum created by each cylinder during the intake phase. Similarly, exhaust gases are pushed out the back of the engine through the exhaust runner into a common exhaust system.

A Fixed or conventional spark plug mounting design may be used with this system, or for more desirable results, spark plugs can be incorporated into the rotating shafts positioned in a manner consistent with ignition timing for each individual cylinder. As each spark plug rotates into position the center electrode charge is provided during the power phase. This spark plug configuration allows the spark plug to be placed directly down the centerline of the piston creating an even combustion pressure across the piston surface. Compression is achieved as the sleeved shaft rotates to a solid surface in between the intake port opening and the spark plug electrode.

DETAILED DESCRIPTION

Figure 1:
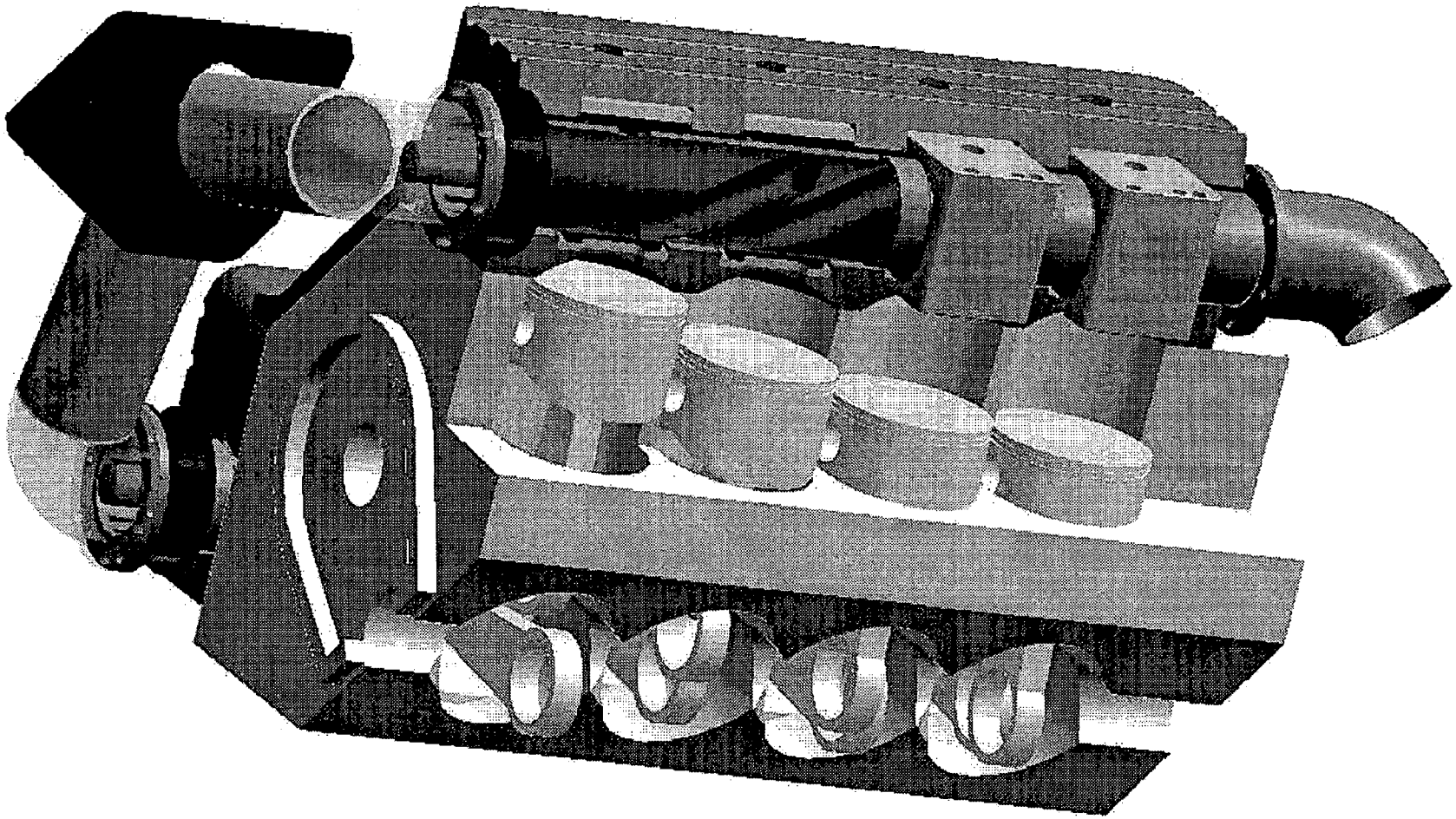
FIG. 1: A cross sectional view of the engine.
Figure 2:
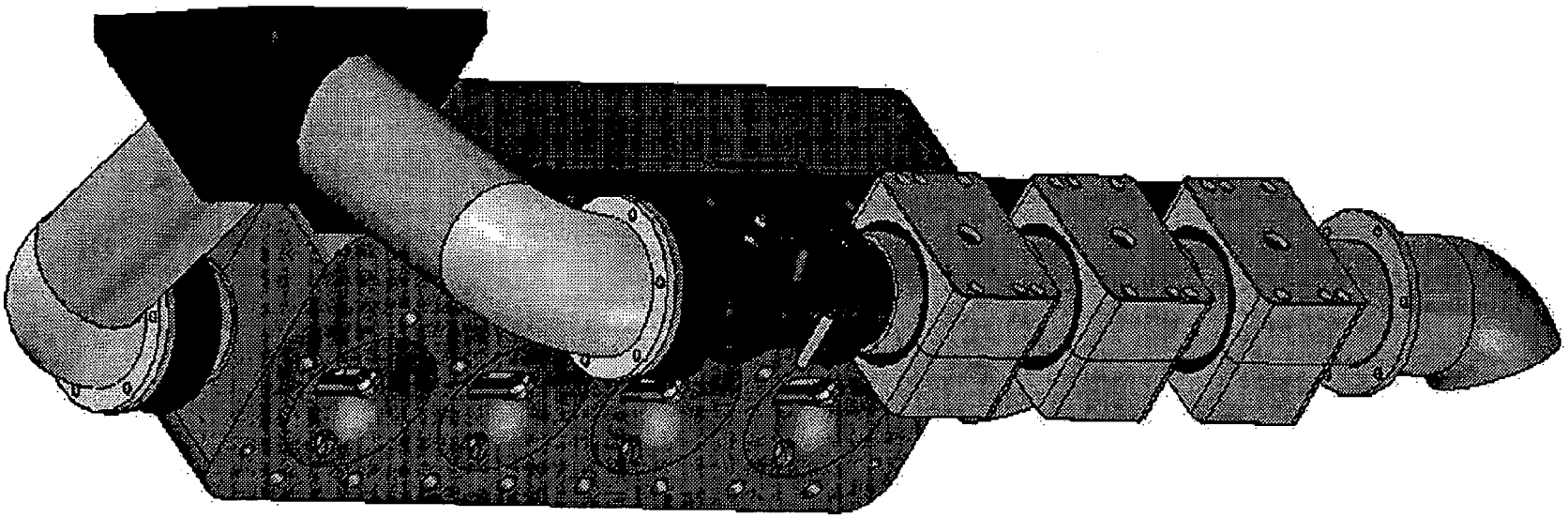
FIG. 2: A view of the heli-shaft element.
Figure 3:
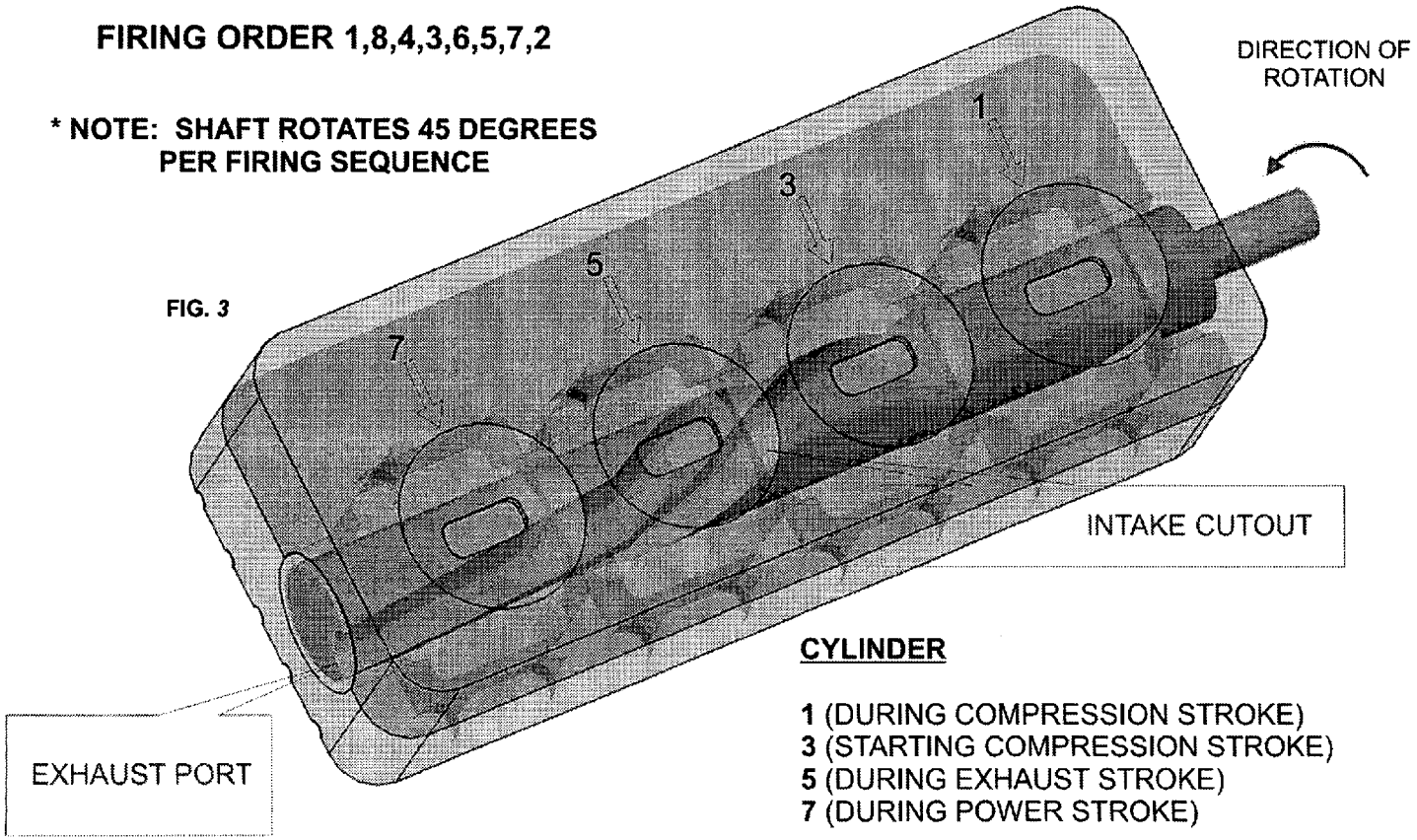
FIG. 3: An exhaust port of a prior art engine.
Figure 4:
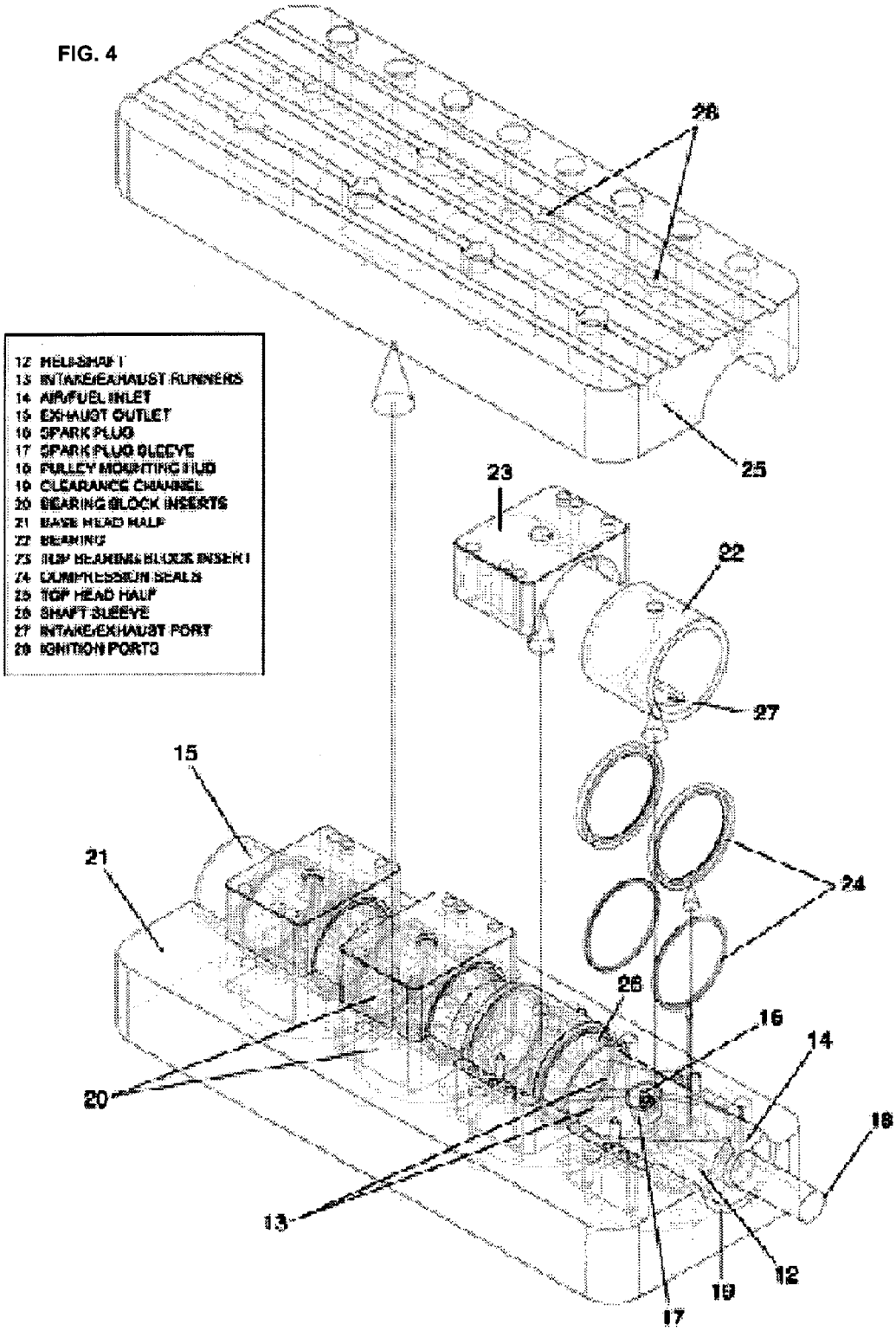
FIG. 4: A detailed view of elements in the cylinder head.
Figure 5:
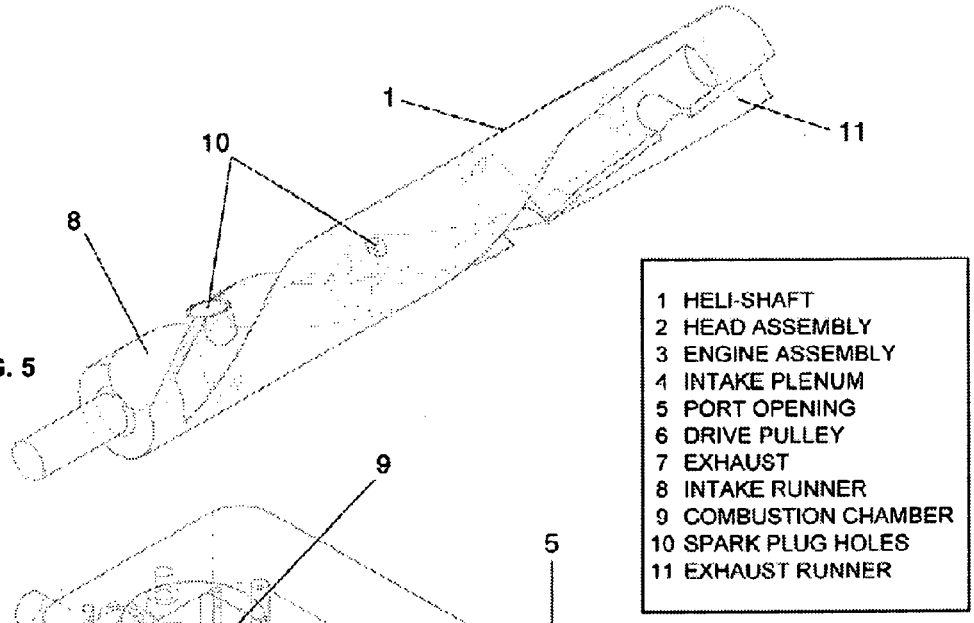
FIG. 5: A view of the heli-shaft.
Figure 6:
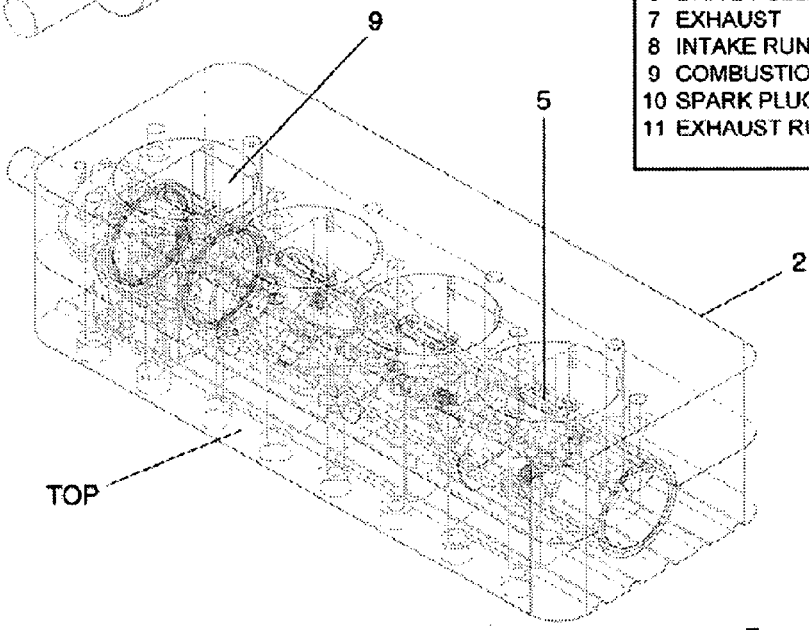
FIG. 6: A view of the heli-shaft in Straight line engine.
Figure 7:
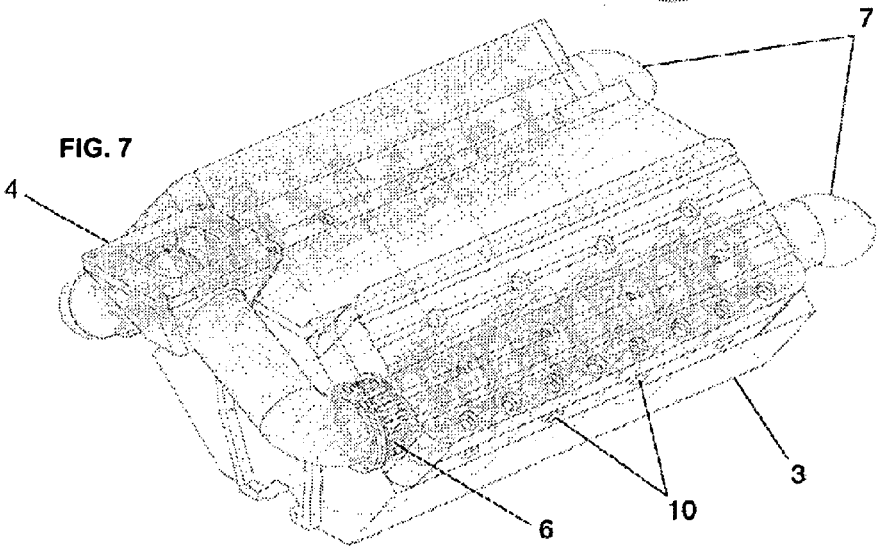
FIG. 7: A view of the heli-shaft in a V-type engine.

The HELI-SHAFT is comprised of a shaft with two helical and parallel runners cutout along its length. These runners provide both air/fuel intake and exhaust outlet. The intake runner has an opening at the front end of the shaft to provide an inlet for the air/fuel mixture to enter from the intake plenum. At the end of the exhaust runner is an outlet for the exhaust gases to exit the back of the shaft. The shaft provides locations for spark plugs to be inserted and is fitted with a sleeve of the same length to enclose the dual runner system. The sleeve contains port openings located over each intake and exhaust runner positioned to provide alignment with individual engine cylinders matching both the firing order and cycle timing of the engine. At the front or intake end of the shaft extends a mounting hub for attaching a V-groove drive pulley. The HELI-SHAFT drive pulley(s) are connected to the crankshaft with a V-groove belt and rotate one half the speed of the crankshaft during operation.

The engine head itself is split into two half's providing a clearance channel for the sleeved shaft assembly. Split bearing block inserts mount in the base half and provide a through port opening above each combustion chamber. Self lubricating bearings with ports aligned with the base bearing block insert ports are placed in the bearing blocks and the shaft is inserted through the center of each. The top bearing block inserts and compression seals are enclosed with the top half of the head providing a cover for the assembly.

What is claimed is:

1. A multiple cylinder internal combustion engine including:

a piston, a crankshaft, a connecting rod connecting said piston to said crankshaft, a cylinder head, a combustion chamber defined as the area between the piston and the cylinder head, a bore in the cylinder head, the bore being perpendicular to each cylinder and parallel to the cylinder bank, a rotary valve system provided in said bore, said rotary valve system containing a solid cylindrical shaft, and a cylindrical tube fixedly attached to the outside of said shaft, said shaft including a helical intake groove and a helical exhaust groove along the surface of the outside diameter, said helical intake groove and said helical exhaust groove being independent of one another, said cylindrical tube having multiple openings to allow fluid communication between the combustion chamber and the helical intake and exhaust grooves, and allowing the fluid communication during the proper intervals of a combustion cycle, multiple intake/exhaust ports in said cylinder head, each individual intake/exhaust port providing fluid communication between a corresponding combustion chamber and said rotary valve system, the length of the helical intake groove being continuously supplied with an air/fuel mixture via a single air entry port, the length of the exhaust helical groove being sequentially filled via a corresponding intake/exhaust port opening and expelled through a single exhaust exit port, the helical intake groove and the helical exhaust groove being aligned on the shaft so as to be distanced from the intake/exhaust port during a compression phase of the combustion process.

* * * * *